US005551502A

United States Patent [19]

Matsubayashi et al.

[11] Patent Number: 5,551,502

[45] Date of Patent: Sep. 3, 1996

[54] PRESSURIZING CONTROL METHOD AND PRESSURIZING CONTROL SYSTEM FOR LOW-PRESSURE CASTING

[75] Inventors: Nobuyuki Matsubayashi; Toru Takeshita, both of Hiroshima-ken, Japan

[73] Assignee: Mazda Motor Corporation, Hiroshima-ken, Japan

[21] Appl. No.: 439,939

[22] Filed: May 12, 1995

[30] Foreign Application Priority Data

May 13, 1994 [JP] Japan ..... 6-099474

[51] Int. Cl.[6] ..... B22D 46/00; B22D 27/13; B22D 17/06; B22D 17/32

[52] U.S. Cl. ..... 164/457; 164/119; 164/306; 164/155.3

[58] Field of Search ..... 164/457, 119, 164/306, 155.3

[56] References Cited

U.S. PATENT DOCUMENTS 4,585,050 4/1986 Merrien et al. ..... 164/457
5,372,181 12/1994 Watanabe et al. ..... 164/457

FOREIGN PATENT DOCUMENTS 2251355 10/1990 Japan .

*Primary Examiner*—Jack W. Lavinder
*Assistant Examiner*—I. H. Lin
*Attorney, Agent, or Firm*—Sixbey, Friedman, Leedom & Ferguson, P.C.; Gerald J. Ferguson, Jr.; Donald R. Studebaker

[57] ABSTRACT

In a low-pressure casting in which molten metal is introduced into a cavity of a casting mold under a pressure applied to the surface of the molten metal according to a preset reference pressurizing pattern, the reference pressurizing pattern is corrected when that the cavity has been filled with molten metal is detected and the pressure applied to the molten metal surface is controlled according to the reference pressurizing pattern after the correction. The pressure difference between a set pressure at a predetermined time in the reference pressurizing pattern after the correction and a set pressure at the corresponding time in the reference pressurizing pattern before the correction, is calculated and a set pressure for the period up to the time the cavity is filled with molten metal in the reference pressurizing pattern for the next casting cycle is corrected on the basis of the calculated pressure difference.

20 Claims, 7 Drawing Sheets

PRESSURIZING CONTROL METHOD AND PRESSURIZING CONTROL SYSTEM FOR LOW-PRESSURE CASTING

BACKGROUND OF THE INVENTION

1. Field of the Invention

This invention relates to a pressurizing control method and a pressurizing control system for low-pressure casting in which molten metal is lifted into a casting mold by a pressure applied to the molten metal surface.

2. Description of the Prior Art

When casting an aluminum cylinder head of an automotive engine or the like, there has been employed so-called low-pressure casting in which molten metal in a crucible is lifted into a cavity of a casting mold through a stalk under a pressure applied to the surface of the molten metal by a pressurizing means.

Generally in a low-pressure casting apparatus, it is preferred to rapidly pressurize the molten metal surface until the molten metal reaches the gate of the casting mold in order to prevent a drop in the temperature of the molten metal, and it is required to pressurize the molten metal surface under a suitable pressure determined according to the shape of the product and the like from the time the molten metal begins to be supplied to the cavity to the time the molten metal fills the cavity. Further after the molten metal fills the cavity, it is desired to pressurize the molten metal surface under a high pressure in order to solidify the molten metal under a good condition. For this purpose, in a low-pressure casting apparatus, the pressure applied to the molten metal surface is controlled in a preset pressurizing pattern.

In order to obtain a dense cast product free from shrinkage void, the pressure applied to the molten metal surface is to be constantly proper in a filled state where the cavity is filled with the molten metal. As a system for controlling the pressure to be optimal in a filled state, there has been known a system disclosed in Japanese Unexamined Patent Publication No. 2(1990)-251355.

In the low-pressure casting apparatus, a filling sensor which detects that the cavity has been filled with molten metal and outputs a filling signal and a timer which outputs an elapse signal when a predetermined time lapses after starting of molten metal supply to the cavity are provided, and the pressurizing pattern is changed on the basis of the filling signal when the filling signal is output before the predetermined lapses and on the basis of the elapse signal when the filling signal is not output before the predetermined lapses.

Accordingly, the pressure applied to the molten metal surface in the filled state can be constantly controlled to be optimal and a dense product structure free from void can be obtained.

However, the low-pressure casting apparatus is disadvantageous in that the pressure applied to the molten metal surface is controlled in a preset pattern before the cavity is filled with the molten metal and accordingly, only a predetermined pressure is applied to the molten metal surface even if the molten metal in the crucible is reduced and the molten metal level lowers, which makes it difficult to supply the molten metal at a desired rate. When the predetermined lapses and the elapse signal is output, the pressurizing pattern is changed even if the cavity is not filled with the molten metal yet, whereby casting defect is generated and the cast product cannot be of a desired shape.

SUMMARY OF THE INVENTION

In view of the foregoing observations and description, the primary object of the present invention is to provide a pressurizing control method and a pressurizing control system for low-pressure casting in which the pressure applied to the molten metal surface is corrected according to the condition of the molten metal surface also before a cavity of a casting mold is filled with molten metal so that molten metal is filled in the cavity in a predetermined time, whereby a high quality cast product free from cast defect can be obtained.

In accordance with an aspect of the present invention, there is provided a pressurizing control method of controlling the pressure applied to the molten metal surface in a low-pressure casting in which molten metal is introduced into a cavity of a casting mold under a pressure applied to the surface of the molten metal according to a preset reference pressurizing pattern. The method comprises the steps of correcting said reference pressurizing pattern when that the cavity has been filled with molten metal is detected, controlling the pressure applied to the molten metal surface according to the reference pressurizing pattern after the correction, calculating the pressure difference between a set pressure at a predetermined time in the reference pressurizing pattern after the correction and a set pressure at the corresponding time in the reference pressurizing pattern before the correction, and correcting a set pressure for the period up to the time the cavity is filled with molten metal in the reference pressurizing pattern for the next casting cycle on the basis of the calculated pressure difference.

Preferably said pressure difference is a difference between a maximum set pressure in the reference pressurizing pattern after the correction and a maximum set pressure in the reference pressurizing pattern before the correction.

Said pressure difference may be a difference between a detected pressure detected at the time that the cavity has been filled with molten metal is detected, and the set pressure for the time that the cavity has been filled with molten metal is detected in the reference pressurizing pattern.

Preferably said reference pressurizing pattern after the correction in each casting cycle is employed as the reference pressurizing pattern in the next casting cycle.

Generally when the detected pressure at the time that the cavity has been filled with molten metal is detected is lower than the set pressure for the same time in the reference pressurizing pattern, the set pressure for the time that the cavity has been filled with molten metal is detected in the reference pressurizing pattern for the next casting cycle is lowered by the difference between the detected pressure and the set pressure, and when the detected pressure at the time that the cavity has been filled with molten metal is detected is higher than the set pressure for the same time in the reference pressurizing pattern, the set pressure for the time that the cavity has been filled with molten metal is detected in the reference pressurizing pattern for the next casting cycle is increased by the difference between the detected pressure and the set pressure.

In accordance with another aspect of the present invention, there is provided a pressurizing control system for controlling the pressure applied to the molten metal surface in a low-pressure casting apparatus in which molten metal is introduced into a cavity of a casting mold under a pressure applied to the surface of the molten metal by a pressurizing means. The system comprises a set pressure storing means which stores set pressures to be applied to the molten metal surface, an applied pressure calculating means which calculates the pressure to be applied to the molten metal surface on the basis of the pressure difference between a detected pressure at the time that the cavity is filled with molten metal is detected and the set pressure for that time, and a pressurizing control means which controls the pressurizing means on the basis of the pressure to be applied to the molten metal surface calculated by the applied pressure calculating means.

Preferably the system further comprises a pressure difference calculating means which calculates the pressure difference between the detected pressure and the set pressure on the basis of the pressure to be applied to the molten metal surface calculated by the applied pressure calculating means, a set pressure correcting means which corrects the set pressures stored in the set pressure storing means on the basis of the pressure difference calculated by the pressure difference calculating means, and a set pressure converting means which converts the set pressures corrected by the set pressure correcting means to set pressures for the next casting cycle and causes the set pressure storing means to store them.

Preferably said pressure difference is a difference between the highest of the set pressures stored in the set pressure storing means and the highest of the detected pressures.

Said pressure difference is a difference between a detected pressure detected at the time that the cavity has been filled with molten metal is detected, and the set pressure for the time that the cavity has been filled with molten metal is detected.

Generally when the detected pressure at the time that the cavity has been filled with molten metal is detected is lower than the set pressure for the same time stored in the set pressure storing means, the set pressure for the time that the cavity has been filled with molten metal is detected for the next casting cycle is lowered by the difference between the detected pressure and the set pressure, and when the detected pressure at the time that the cavity has been filled with molten metal is detected is higher than the set pressure for the same time stored in the set pressure storing means, the set pressure for the time that the cavity has been filled with molten metal is detected for the next casting cycle is increased by the difference between the detected pressure and the set pressure.

In accordance with the present invention, the predetermined pressurizing pattern can be changed according to the actual condition of the molten metal surface or the level of the molten metal surface, and accordingly, the pressure applied to the molten metal surface in the period up to completion of filling can be optimized. That is, the pressure applied to the molten metal surface can be controlled in an optimal manner taking into account change in the condition of the molten metal surface due to reduction or increase in the amount of molten metal in the furnace and due to generation of stack of oxide of the molten metal. Thus a high quality cast product free from casting defect can be obtained.

When the pressure difference is calculated as the difference between a maximum set pressure in the reference pressurizing pattern after the correction and a maximum set pressure in the reference pressurizing pattern before the correction, the pressure difference can be clearly calculated, whereby correction of the reference pressurizing pattern can be more accurately effected and the pressure applied to the molten metal surface in the period up to completion of filling can be optimized. Thus a high quality cast product free from casting defect can be obtained.

When the pressure difference is calculated as the difference between the detected pressure at the time that the cavity has been filled with molten metal is detected and the set pressure for the time that the cavity is filled with molten metal is detected, the pressure applied to the molten metal surface can be quickly calculated without correcting all the set pressures in the reference pressurizing pattern, whereby the pressure applied to the molten metal surface in the period up to completion of filling can be optimized.

Further when the corrected reference pressurizing pattern in one casting cycle is used as the reference pressurizing pattern in the next casting cycle, the pressure applied to the molten metal surface can be optimally controlled according to the molten metal surface condition, whereby casting defect due to molten metal surface condition can be avoided and a high quality cast product can be obtained.

DESCRIPTION OF THE PREFERRED EMBODIMENT

Figure 1:
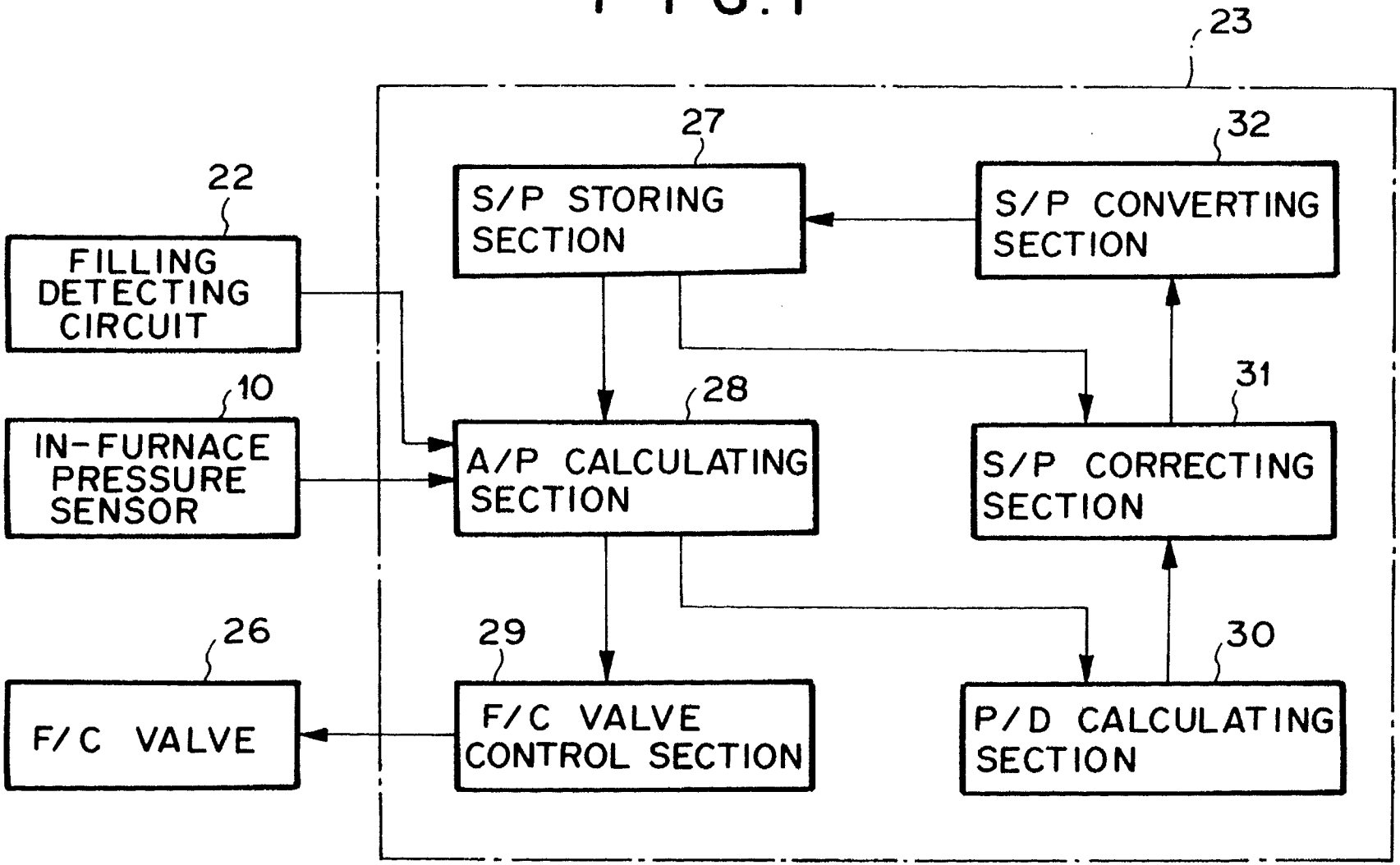
FIG. 1 is a block diagram showing a pressurizing control system in accordance with an embodiment of the present invention.
Figure 2:
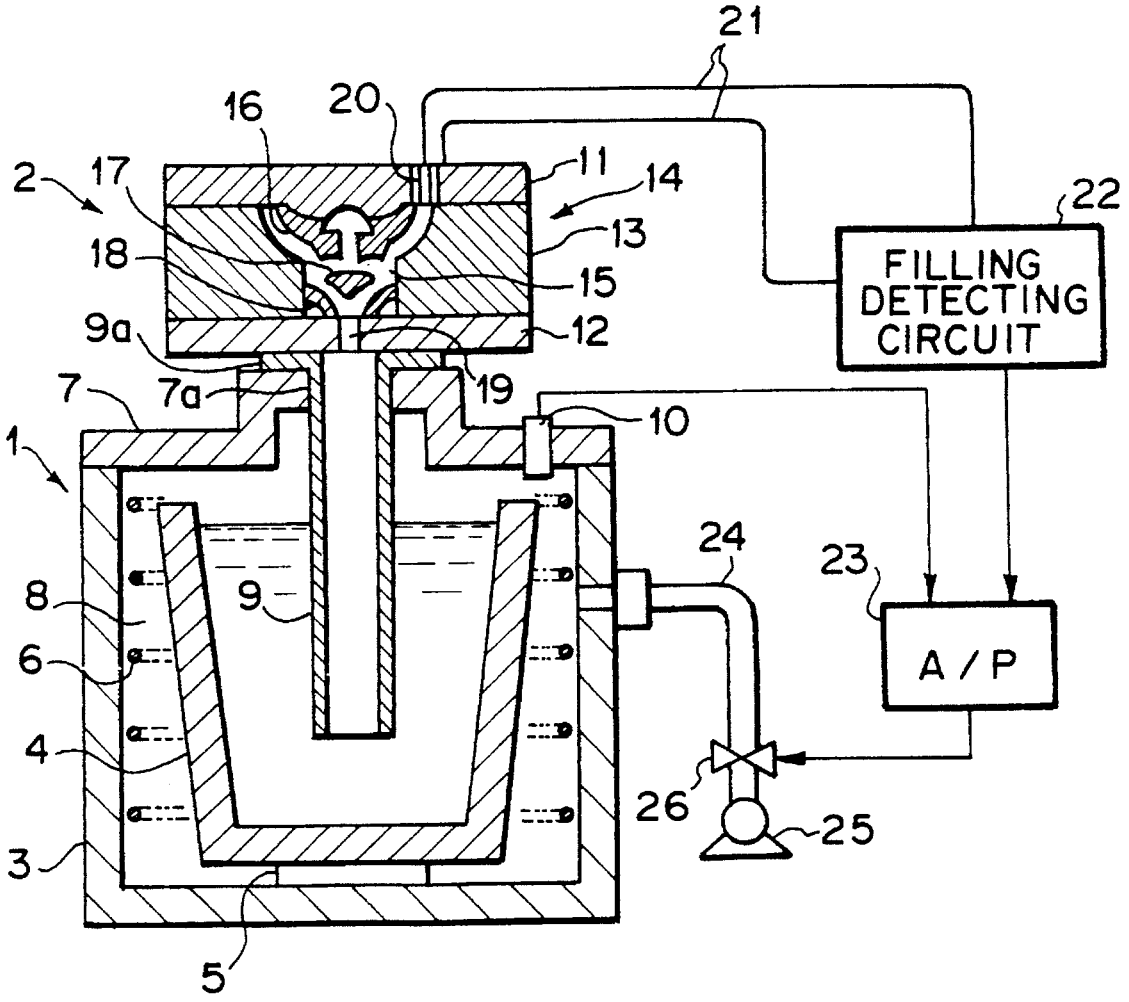
FIG. 2 is a schematic view showing a low-pressure casting apparatus provided with the pressurizing control system shown in FIG. 1.

A low-pressure casting apparatus to which a pressuring control method in accordance with an embodiment of the present invention comprises a molten metal storing section 1 in which molten metal is stored and a casting section 2 in which molten metal supplied from the molten metal storing section 1 is casted.

The molten metal storing section 1 has a heat insulating furnace 3 in the form of a vessel open upward. A crucible 4 for containing molten metal is placed on a support 5 in the heat insulating furnace 3, and a heater 6 for heating the molten metal in the crucible 4 is provided on the inner surface of the furnace 3. The upper end of the furnace 3 is closed in an air-tight fashion by a removable lid 7, whereby an air-tight pressurizing room 8 is formed inside the furnace 3.

The lid 7 is provided with an opening **7*a* at the center thereof and a stalk 9 provided with a flange 9*a* at the upper end thereof is fitted in the opening 7*a* with the flange 9a in abutment against the lid 7 and the lower end portion of the stalk 9 dipped into the molten metal in the crucible 4. Further the lid 7 is provided with a pressure sensor 10 which detects the pressure inside the pressurizing room 8. The pressure sensor 10 is connected to a pressurizing control system 23** to be described later.

The casting section 2 is provided with a casting mold 14 comprising an upper mold 11, a lower mold 12 and a side mold 13, and the flange **9*a* of the stalk 9 is sandwiched between the lid 7 and the casting mold 14, whereby the stalk 9 is fixed keeping air-tightness of the inner space of the furnace 3**.

An oil jacket core 16, a water jacket core 17 and a port jacket 18 are disposed in a cavity 15 formed in the casting mold 14 in this order from the top. The cavity 15 is communicated with the stalk 9 through a gate 19 formed in the lower mold 12 and the molten metal in the crucible 4 is supplied to the cavity 15 through the stalk 9.

An insulator ring 20 is inserted into the upper mold 11 and a pair of cables 21 are connected to the upper mold 11 respectively inside and outside the insulator ring 20 so that they are electrically connected to each other when the cavity 15 is filled with molten metal. The cables 21 are connected to a filling detecting circuit 22 which outputs a filling signal when the cables 21 electrically connected to each other.

The filling detecting circuit 22 outputs the filling signal to the pressurizing control system 23 which controls the pressure in the pressurizing room 8.

An air supply passage 24 is connected to a side wall of the furnace 3 and pressurized air is introduced into the pressurizing room 8 through the air supply passage 24 from an air pump 25. The molten metal in the crucible 4 is lifted into the stalk 9 under the pressure of the pressurized air and is supplied to the cavity 15.

The air supply passage 24 is provided with a flow control valve 26 which controls flow of pressurized air supplied to the pressurizing room 8 from the air pump 25. By controlling the flow control valve 26, flow of pressurized air supplied to the pressurizing room 8 is controlled and the pressure in the pressurizing room 8 is controlled.

Figure 3:
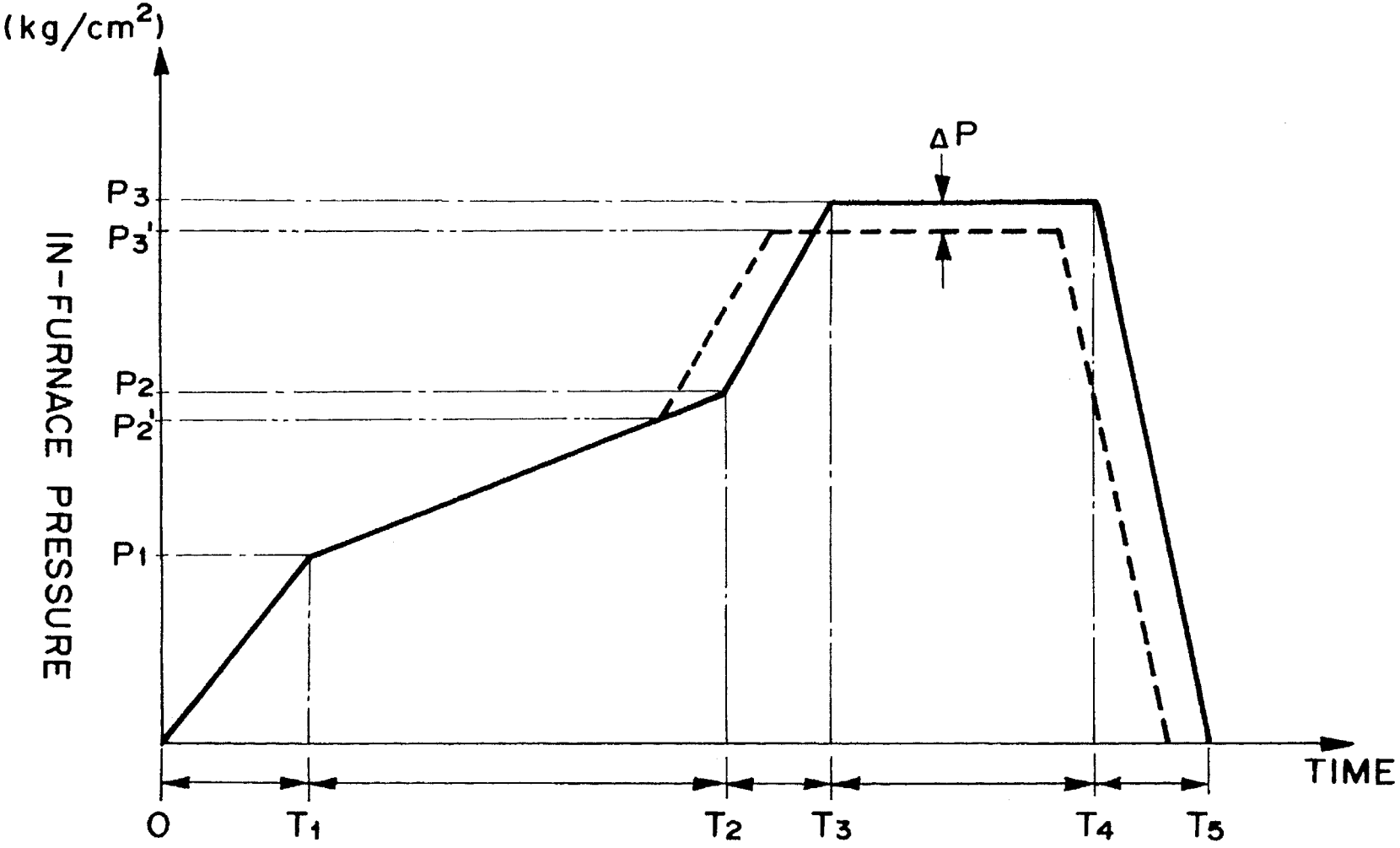
FIG. 3 is a graph showing an example of the pressurizing pattern.

The flow control valve 26 is connected to the pressurizing control system 23 and the opening of the valve 26 is controlled by the pressurizing control system 23. The pressurizing control system 23 controls the opening of the valve 26 so that the pressure in the pressurizing room changes with time in a predetermined pattern as shown in FIG. 3.

The pressurizing control system 23 is provided therein a timer which outputs an elapse signal when a predetermined time lapses and a CPU (central processing unit), and comprises a set pressure storing section 27, an applied pressure calculating section 28, a flow control valve control section 29, a pressure difference calculating section 30, a set pressure correcting section 31 and a set pressure converting section 32.

The set pressure storing section 27 stores an initial value and a corrected value of the pressure at each time in a preset pressurizing pattern, and the applied pressure calculating section 28 calculates a pressure to be applied to the molten metal surface on the basis of the set pressure stored in the set pressure storing section 27 and the signal from the pressure sensor 10 or the filling detecting circuit 22.

The flow control valve control section 29 controls the opening of the flow control valve 26 on the basis of the applied pressure calculated by the applied pressure calculating section 28.

The pressure difference calculating section 30 calculates the difference between the maximum pressure stored in the set pressure storing section 27 and the maximum pressure calculated on the basis of the applied pressure calculated by the applied pressure calculating section 28.

The set pressure correcting section 31 corrects the set pressure at each time in the preset pressurizing pattern on the basis of the pressure difference calculated by the pressure difference calculating section 30.

The set pressure converting section 32 converts the value of the set pressure corrected by the set pressure correcting section 31 to a form which can be stored in the set pressure storing section 27.

In the low-pressure casting apparatus, it is desired to quickly pressurize the molten metal surface in order to prevent a drop in temperature until the molten metal is lifted through the stalk to the gate, and it is required to pressurize the molten metal surface under a suitable pressure determined according to the shape of the product and the like from the time the molten metal begins to be supplied to the cavity to the time the molten metal fills the cavity. Further after the molten metal fills the cavity, it is desired to pressurize the molten metal surface under a high pressure in order to solidify the molten metal under a good condition.

The pressurizing control method carried out by the pressurizing control system 23 will be described with reference to FIGS. 3 and 4, hereinbelow.

The pressurizing control system 23 changes the set pressure with time to control the pressure applied to the molten metal surface. That is, as shown in FIG. 3, in the pressurizing control system 23, each casting cycle is divided into a period from beginning of the casting cycle to time T1 when molten metal is lifted to the gate (will be referred to as "pre-pressurizing period", hereinbelow), a period from the time T1 to time T2 when the molten metal fills the cavity (will be referred to as "filling period", hereinbelow), a period from the time T2 to a time T3 when the pressure applied to the molten metal in the cavity is increased (will be referred to as "pressure increasing period", hereinbelow), a period from the time T3 to time T4 when the pressure is held at the pressure obtained in the pressure increasing period (will be referred to as "pressure holding period", hereinbelow), and a period from the time T4 to time T5 when the pressure is released (will be referred to as "pressure releasing period", hereinbelow). The set pressure is changed for each period and the pressure applied to the molten metal surface is controlled.

That is, the pressure in the pressurizing room 8 is controlled so that the pressure converges on a first set pressure P1 in the pre-pressurizing period, on a second set pressure P2 in the filling period, and on a third set pressure P3 in the pressure increasing period.

The first to third set pressures P1 to P3 have been stored in the set pressure storing section 27.

When the filling detecting circuit 22 detects that the cavity 15 has been filled with molten metal in the filling period, the pressure in the pressurizing room 8 at that time is detected by the pressure sensor 10 and the third set pressure P3 for the pressure increasing period is corrected to P3' on the basis of the detected pressure P2' at the time the filling detecting circuit 22 detects that the cavity 15 has been filled by the applied pressure calculating section 28. Then the pressure in the pressurizing room 8 is thereafter controlled on the basis of the corrected third set pressure P3' as shown by the broken line in FIG. 3.

The pressure difference calculating section 30 calculates the difference $\Delta P$ between the corrected third set pressure P3' and the third set pressure P3 before correction. The set pressure correcting section 31 corrects the first to third set pressures P1 to P3 stored in the set pressure storing section 27 on the basis of the pressure difference $\Delta P$ and the set pressure converting section 32 updates the set pressures P1 to p3 to the corrected values and causes the set pressure storing section 27 to store the updated set pressures P1 to p3.

Figure 4:
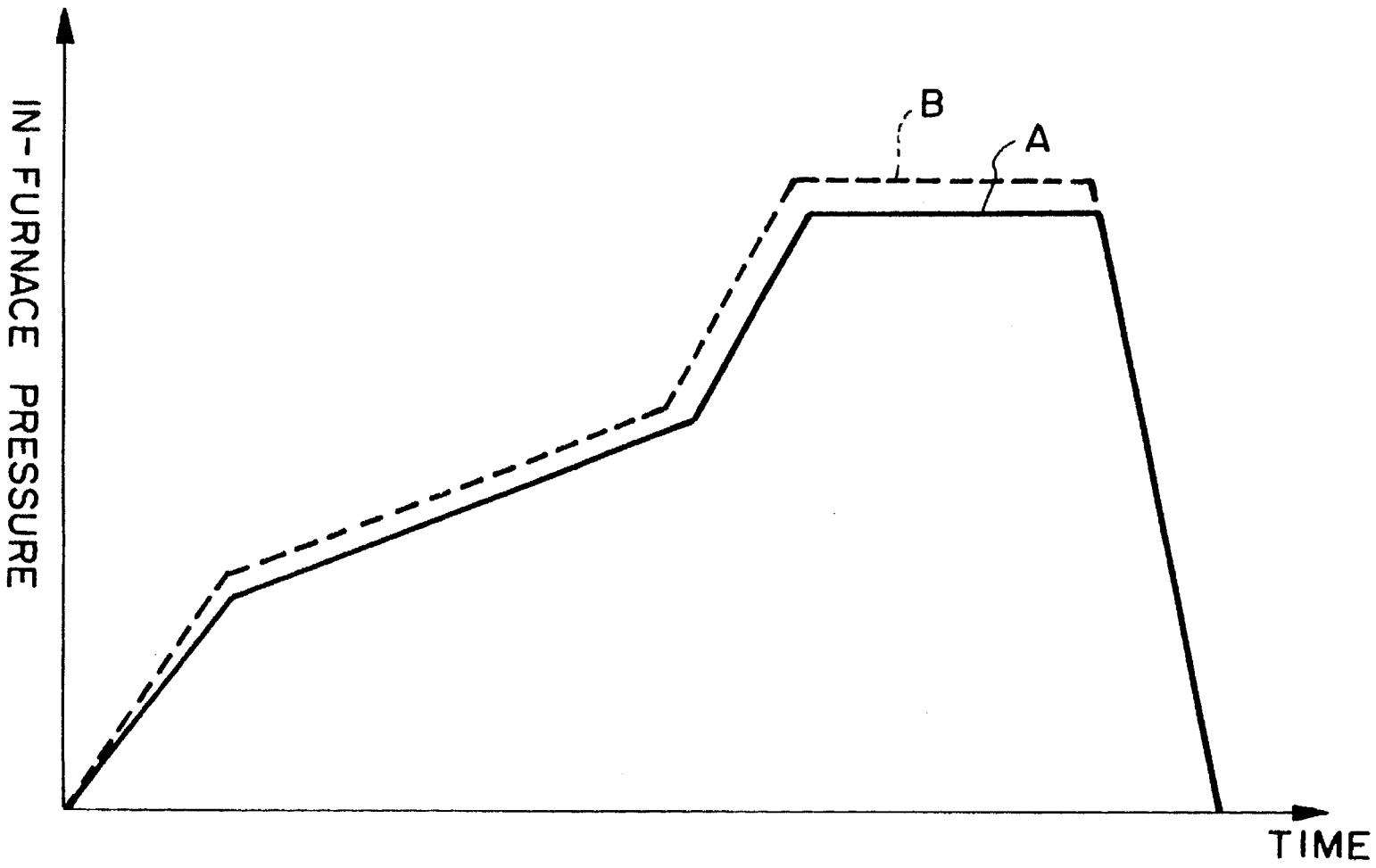
FIG. 4 is a graph showing the pressurizing pattern after correction in comparison with that before correction.

Accordingly the pressurizing pattern is changed from pattern B to pattern A as shown in FIG. 4, and in the next casting cycle, the pressure is controlled in the pressurizing pattern A.

Figure 5:
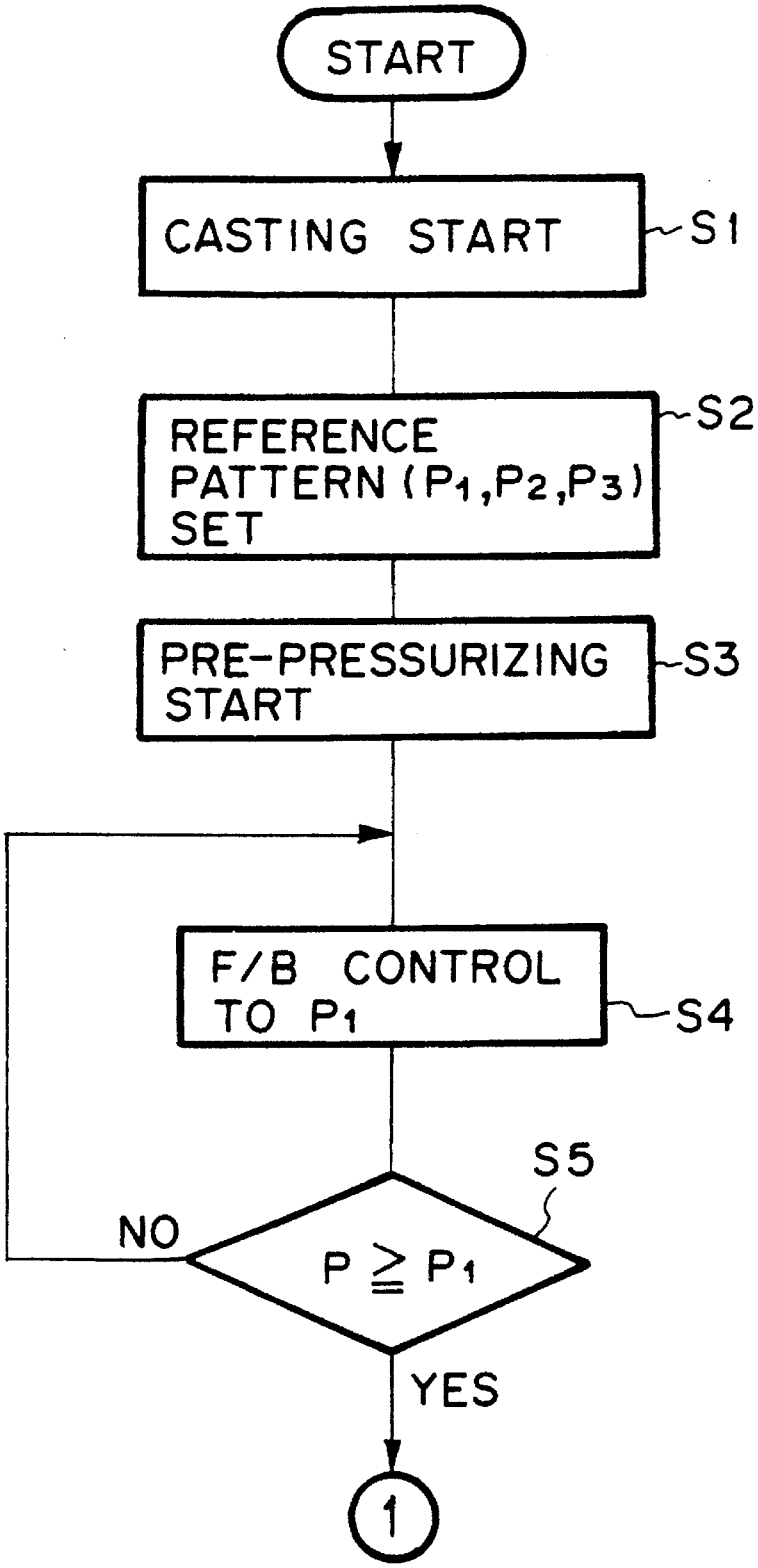
FIGS. 5 to 7 show a flow chart for illustrating the operation of the pressurizing control system.
Figure 6:
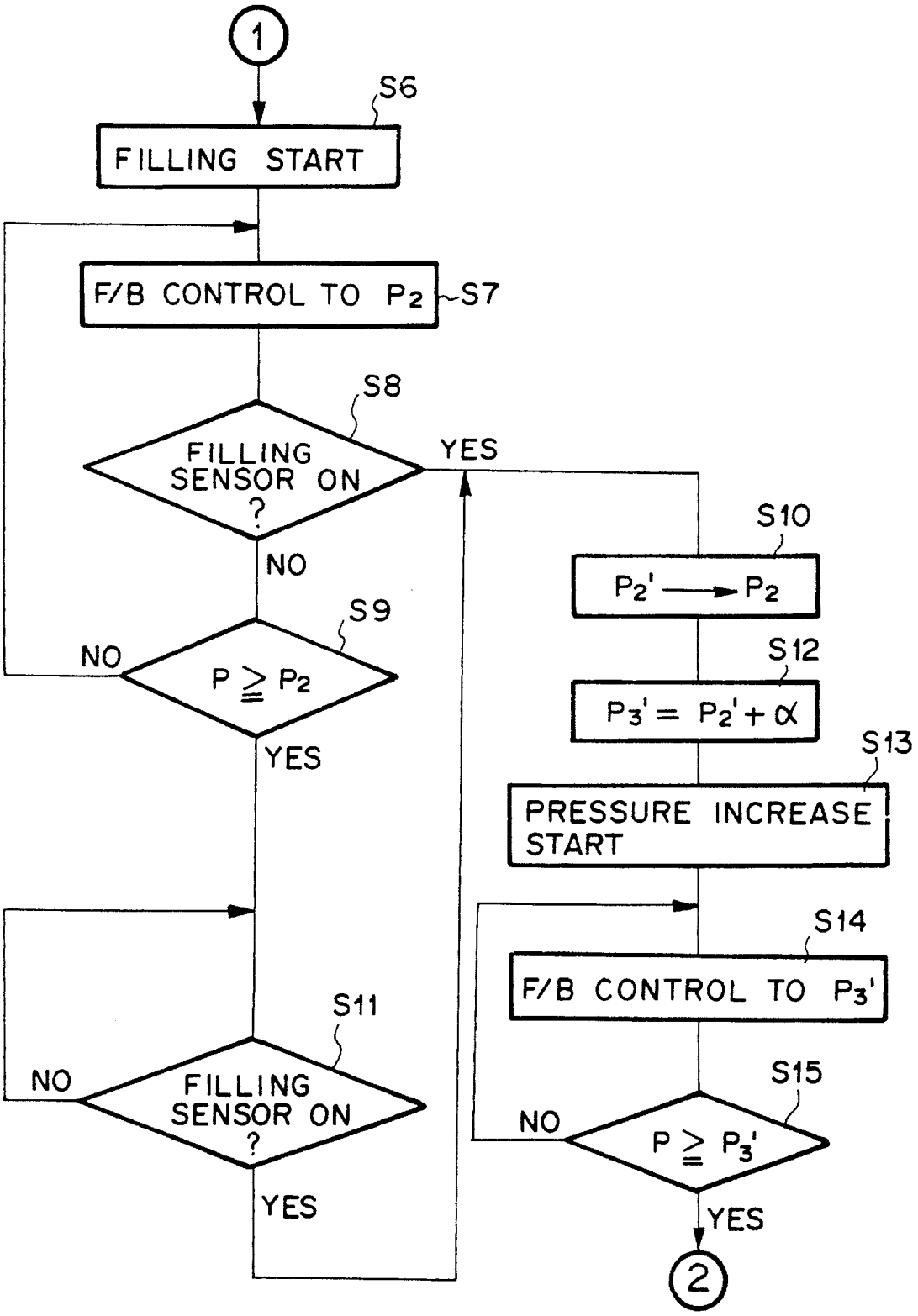
Figure 7:
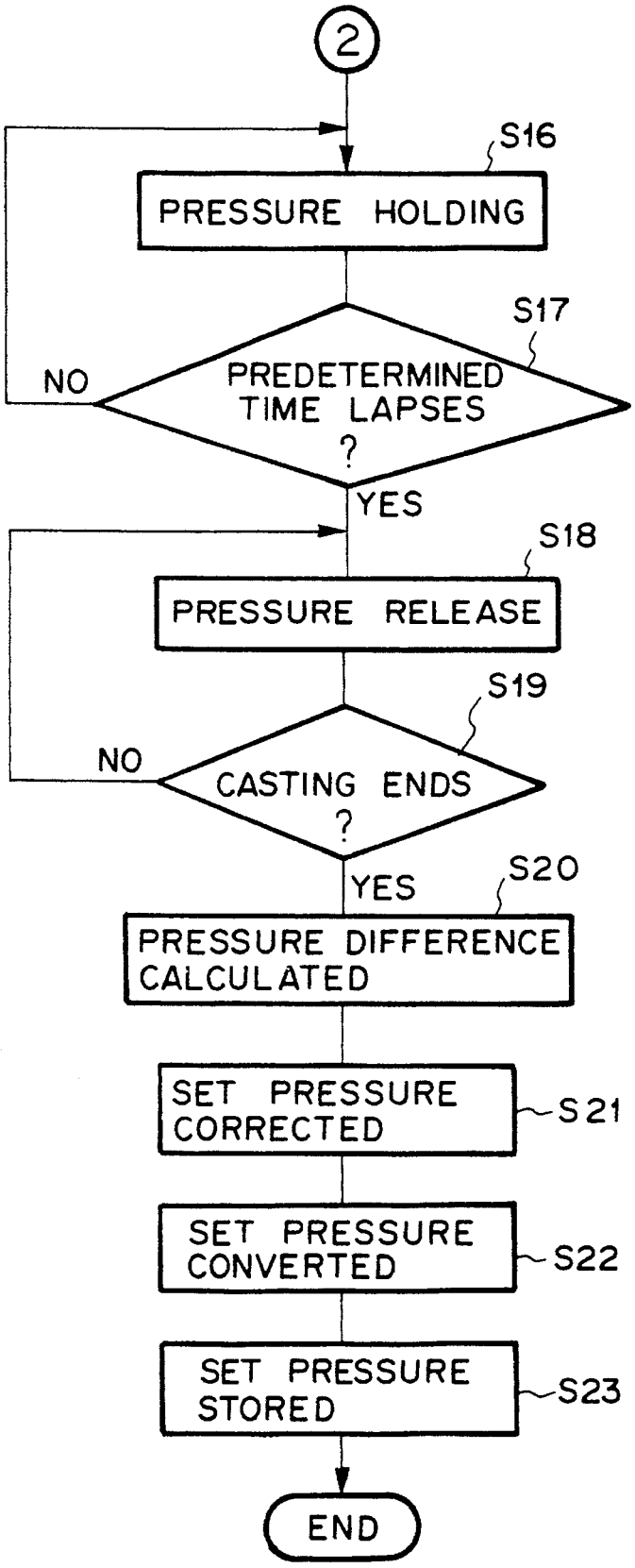

The pressurizing control method described above will be described in more detail with reference to the flow chart shown FIGS. 5 to 7, hereinbelow.

When casting is started (step S1), a reference pressurizing pattern (or reference target pressures P1, P2 and P3) is set (step S2). Then pre-pressurizing is started (step S3) and the pressure in the pressurizing room 8 is feedback-controlled to converge on the first target (set) pressure P1 (steps S4 and S5).

When the detected pressure P reaches the first target pressure P1, molten metal is started to be filled in the cavity (step S6 in FIG. 6) and the pressure in the pressurizing room 8 is feedback-controlled to converge on the second target (set) pressure P2.

When the cavity is filled with molten metal before the detected pressure P reaches the second target pressure P2 (steps S7 and S8), the second target pressure P2 is corrected to the detected pressure P2' at the time the cavity is filled with molten metal (step S10). When the cavity is not filled with molten metal before the detected pressure P reaches the second target pressure P2 (steps S7 to S9), the system waits for the cavity to be filled with molten metal (step S11) and the second target pressure P2 is corrected to the detected pressure P2' at the time the cavity is filled with molten metal which is higher than the second target pressure P2 (step S10). The third target pressure P3 is corrected to P3' which is obtained by adding a correction value $\alpha$ to the corrected second target pressure P2' (step S12) and pressure increase is started (step S13). The pressure in the pressurizing room 8 is feedback-controlled to converge on the corrected third target pressure P3' (steps S14 and S15). When the detected pressure P reaches the corrected third target pressure P3', pressure holding is started. (step S16 in FIG. 7)

The pressure in the pressurizing room 8 is held at the corrected third target pressure P3' for a predetermined time (steps S16 and S17) and then released (step S18). When casting is completed (step S19), the pressure difference $\Delta P$ between the third target pressure before correction P3 and the third target pressure after correction P3' ($\Delta P$=P3'-P3) is calculated (step S20) and the target (set) pressures P1 to P3 are corrected on the basis of the pressure difference $\Delta P$ (step S21). That is, P1=P1+$\Delta P$, P2=P2+$\Delta P$, P3=P3+$\Delta P$. When the cavity is filled before the detected pressure P reaches the second target pressure P2, $\Delta P$ is negative, and when the cavity is filled after the detected pressure P reaches the second target pressure P2, $\Delta P$ is positive. The corrected target pressures are converted to new target pressures P1 to P3 for the next casting cycle (step S22) and stored in the set pressure storing section 27 (step S23).

As can be understood from the description above, in accordance with the pressurizing control method of this embodiment, the predetermined pressurizing pattern can be changed according to the actual condition of the molten metal surface or the level of the molten metal surface, and accordingly, the pressure applied to the molten metal surface in the period up to completion of filling can be optimized.

That is, the pressure applied to the molten metal surface can be controlled in an optimal manner taking into account change in the condition of the molten metal surface due to reduction or increase in the amount of molten metal in the furnace and due to generation of stack of oxide of the molten metal. Thus a high quality cast product free from casting defect can be obtained.

In the embodiment described above, since the pressure difference $\Delta P$ is calculated as the difference between the third target pressures before and after correction which are the maximum pressures in the pressurizing patterns before and after correction, the pressure difference $\Delta P$ can be clearly calculated, whereby correction of the reference pressurizing pattern can be more accurately effected and the pressure applied to the molten metal surface in the period up to completion of filling can be optimized. Thus a high quality cast product free from casting defect can be obtained.

Further since the corrected reference pressurizing pattern in one casting cycle is used as the reference pressurizing pattern in the next casting cycle, the pressure applied to the molten metal surface can be optimally controlled according to the molten metal surface condition, whereby casting defect due to molten metal surface condition can be avoided and a high quality cast product can be obtained.

Further since the pressurizing control system is provided with the flow control valve control section 29 which controls the flow control valve 26 for the air pump 25 on the basis of the applied pressure calculated on the basis of the pressure on the molten metal surface at the time that the cavity is filled with molten metal is detected and the set pressure for that time, the pressure applied to the molten metal surface can be optimally controlled according to the molten metal surface condition, whereby casting defect due to molten metal surface condition can be avoided and a high quality cast product can be obtained.

Though in the embodiment described above, the pressure difference $\Delta P$ is calculated as the difference between the third target pressures before and after correction which are the maximum pressures in the pressurizing patterns before and after correction, pressure difference $\Delta P$ may be calculated, for instance, as the difference between the detected pressure at the time that the cavity has been filled with molten metal is detected, i.e., the corrected set pressure P2', and the second set pressure P2 for the time that the cavity is filled with molten metal is detected.

In this case, the pressure applied to the molten metal surface can be quickly calculated without correcting all the set pressures in the reference pressurizing pattern, whereby the pressure applied to the molten metal surface in the period up to completion of filling can be optimized.

What is claimed is:

1. In a low-pressure casting in which molten metal is introduced into a cavity of a casting mold under a pressure applied to the surface of the molten metal according to a preset reference pressurizing pattern, a pressurizing control method of controlling the pressure applied to the molten metal surface comprising the steps of correcting said reference pressurizing pattern when that the cavity has been filled with molten metal is detected, controlling the pressure applied to the molten metal surface according to the reference pressurizing pattern after the correction, calculating the pressure difference between a set pressure at a predetermined time in the reference pressurizing pattern after the correction and a set pressure at the corresponding time in the reference pressurizing pattern before the correction, and correcting a set pressure for the period up to the time the cavity is filled with molten metal in the reference pressurizing pattern as a current reference pressure pattern for the next casting cycle on the basis of the calculated pressure difference.

2. A pressurizing control method as defined in claim 1 in which said pressure difference is a difference between a maximum set pressure in the reference pressurizing pattern after the correction and a maximum set pressure in the reference pressurizing pattern before the correction.

3. A pressurizing control method as defined in claim 2, wherein the reference pressuring pattern includes a pre-pressurizing period starting from a beginning of the pressurizing process to a time when the molten metal is raised to a gate of the casting mold, and a filling period starting from a time when the molten metal begins to be introduced into the cavity to a time when the molten metal has filled the cavity, and that the correction of the set pressure in the reference pressurizing pattern for the next casting cycle comprises at least the correction of a pressure at which the reference pressurizing pattern shifts from the pre-pressurizing period to the filling period.

4. A pressurizing control method as defined in claim 3 wherein the casting mold comprises at least an upper mold and a lower mold, and a molten metal sensor for detecting the presence of the molten metal is provided in the upper mold such that the falling of the cavity with the molten metal is detected when the molten metal sensor detects the presence of the molten metal.

5. A pressurizing control method as defined in claim 1 in which said pressure difference is a difference between a detected pressure detected at the time that the cavity has been filled with molten metal is detected, and the set pressure for the time that the cavity has been filled with molten metal is detected in the reference pressurizing pattern.

6. A pressurizing control method as defined in claim 2 or 5 in which said reference pressurizing pattern after the correction in each casting cycle is employed as the reference pressurizing pattern in the next casting cycle.

7. A pressurizing control method as defined in claim 5, wherein the reference pressuring pattern includes a pre-pressurizing period starting from a beginning of the pressurizing process to a time when the molten metal is raised to a gate of the casting mold, and a filling period starting from a time when the molten metal begins to be introduced into the cavity to a time when the molten metal has filled the cavity, and that the correction of the set pressure in the reference pressurizing pattern for the next casting cycle comprises at least the correction of a pressure at which the reference pressurizing pattern shifts from the pre-pressurizing period to the filling period.

8. A pressurizing control method as defined in claim 7 wherein the casting mold comprises at least an upper mold and a lower mold, and a molten metal sensor for detecting the presence of the molten metal is provided in the upper mold such that the filling of the cavity with the molten metal is detected when the molten metal sensor detects the presence of the molten metal.

9. A pressurizing control method as defined in claim 1 in which when the detected pressure at the time that the cavity has been filled with molten metal is detected is lower than the set pressure for the same time in the reference pressurizing pattern, the set pressure for the time that the cavity has been filled with molten metal is detected in the reference pressurizing pattern for the next casting cycle is lowered by the difference between the detected pressure and the set pressure.

10. A pressurizing control method as defined in claim 9, wherein the reference pressuring pattern includes a pre-pressurizing period starting from a beginning of the pressurizing process to a time when the molten metal is raised to a gate of the casting mold, and a filling period starting from a time when the molten metal begins to be introduced into the cavity to a time when the molten metal has filled the cavity, and that the correction of the set pressure in the reference pressurizing pattern for the next casting cycle comprises at least the correction of a pressure at which the reference pressurizing pattern shifts from the pre-pressurizing period to the filling period.

11. A pressurizing control method as defined in claim 10 wherein the casting mold comprises at least an upper mold and a lower mold, and a molten metal sensor for detecting the presence of the molten metal is provided in the upper mold such that the filling of the cavity with the molten metal is detected when the molten metal sensor detects the presence of the molten metal.

12. A pressurizing control method as defined in claim 1 in which when the detected pressure at the time that the cavity has been filled with molten metal is detected is higher than the set pressure for the same time in the reference pressurizing pattern, the set pressure for the time that the cavity has been filled with molten metal is detected in the reference pressurizing pattern for the next casting cycle is increased by the difference between the detected pressure and the set pressure.

13. A pressurizing control method as defined in claim 12, wherein the reference pressuring pattern includes a pre-pressurizing period starting from a beginning of the pressurizing process to a time when the molten metal is raised to a gate of the casting mold, and a filling period starting from a time when the molten metal begins to be introduced into the cavity to a time when the molten metal has filled the cavity, and that the correction of the set pressure in the reference pressurizing pattern for the next casting cycle comprises at least the correction of a pressure at which the reference pressurizing pattern shifts from the pre-pressurizing period to the filling period.

14. A pressurizing control method as defined in claim 13 wherein the casting mold comprises at least an upper mold and a lower mold, and a molten metal sensor for detecting the presence of the molten metal is provided in the upper mold such that the filling of the cavity with the molten metal is detected when the molten metal sensor detects the presence of the molten metal.

15. A pressurizing control method as defined in claim 1, wherein the reference pressuring pattern includes a pre-pressurizing period starting from a beginning of the pressurizing process to a time when the molten metal is raised to a gate of the casting mold, and a filling period starting from a time when the molten metal begins to be introduced into the cavity to a time when the molten metal has filled the cavity, and that the correction of the set pressure in the reference pressurizing pattern for the next casting cycle comprises at least the correction of a pressure at which the reference pressurizing pattern shifts from the pre-pressurizing period to the filling period.

16. A pressurizing control method as defined in claim 15, wherein the pressurizing rate for the pre-pressurizing period is greater than that for the filling period.

17. A pressurizing control method as defined in claim 15, wherein the casting mold comprises at least an upper mold and a lower mold, and a molten metal sensor for detecting the presence of the molten metal is provided in the upper mold such that the filling of the cavity with the molten metal is detected when the molten metal sensor detects the presence of the molten metal.

18. In a low-pressure casting in which molten metal is introduced into a cavity of a casting mold under a pressure applied to the surface of the molten metal according to a preset reference pressurizing pattern, said preset pressure reference pattern including (i) a pre-pressurizing period starting from the beginning of the pressurizing process to a time when the molten metal is raised to a gate of the casting mold;

(ii) a filling period starting from a time when the molten metal begins to be introduced into the cavity to a time when the molten metal has filled the cavity, the pressurizing rate for the pre-pressurizing period being greater than that for the filling period;

(iii) a pressure increasing period starting from the time when the molten metal has filled the cavity to a time when the pressure is increased by a predetermined value from the pressure value at the time of starting this period, the pressurizing rate for this period being greater than that for the filling period; and (iv) a pressure holding period starting from the time when the pressure increasing period is finished, in this period the pressure is held at a constant level such that the molten metal is solidified;

a pressurizing control method for controlling the pressure applied to the molten metal surface comprising the steps of:

correcting said reference pressurizing pattern when that the cavity has been filled with molten metal is detected by a molten metal sensor, controlling the pressure applied to the molten metal surface according to the reference pressurizing pattern after the correction, calculating the pressure difference between a set pressure in the time section from the pressure increasing period through the pressure holding period in the reference pressurizing pattern after the correction and a set pressure at the corresponding time in the reference pressurizing pattern before the correction, and correcting a set pressure for the time section from the pre-pressurizing period through the filling period in the reference pressurizing as a current reference pressure pattern for the next casting cycle on a basis of the calculated pressure difference.

19. A pressure control method as defined in claim 18, wherein the pressure pattern is shifted to the pressure increasing period irrespective of the reference pressurizing pattern when the molten metal sensor detects the completion of filling of the cavity.

20. A pressure control method as defined in claim 19, wherein the set pressure to be corrected on the basis of the calculated pressure difference, in the reference pressurizing pattern for the next casting cycle is a pressure at which the reference pressurizing pattern shifts from the pre-pressurizing period to the filling period.

* * * * *